US007341427B2

(12) United States Patent
Farmer et al.

(10) Patent No.: US 7,341,427 B2
(45) Date of Patent: Mar. 11, 2008

(54) GAS TURBINE NOZZLE SEGMENT AND PROCESS THEREFOR

(75) Inventors: Andrew David Farmer, West Chester, OH (US); Bangalore Aswatha Nagaraj, West Chester, OH (US); Wenfeng Lu, Mason, OH (US); Ching-Pang Lee, Cincinnati, OH (US); Joseph Michael Guentert, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 11/306,221

(22) Filed: Dec. 20, 2005

(65) Prior Publication Data

US 2007/0141368 A1 Jun. 21, 2007

(51) Int. Cl.
*F04D 9/02* (2006.01)

(52) U.S. Cl. ..... 415/191; 415/200; 415/115; 415/211.2

(58) Field of Classification Search ..... 415/115, 415/200, 191, 211.1; 428/652, 680; 148/408, 148/410, 427, 428
See application file for complete search history.

(56) References Cited

U.S. PATENT DOCUMENTS 5,236,745 A 8/1993 Gupta et al. ..... 427/454
5,248,240 A 9/1993 Correia ..... 415/209.1
5,316,866 A 5/1994 Goldman et al. ..... 428/621
5,636,439 A 6/1997 Cunha et al. ..... 29/889.22
6,444,057 B1 * 9/2002 Darolia et al. ..... 148/428
6,905,559 B2 * 6/2005 O'Hara et al. ..... 148/410
6,932,568 B2 8/2005 Powis et al. ..... 415/189
6,966,956 B2 * 11/2005 Koizumi et al. ..... 148/428

* cited by examiner

*Primary Examiner*—Ninh H. Nguyen
(74) *Attorney, Agent, or Firm*—William Scott Andes; Gary M. Hartman; Domenica N. S. Hartman

(57) ABSTRACT

A gas turbine engine nozzle segment and process for producing such a nozzle segment to exhibit improved durability and aerodynamic performance. The process produces a nozzle segment having at least one vane between and interconnecting a pair of platforms. The nozzle segment is cast from a gamma prime-strengthened nickel-base superalloy, on whose surface is thermal sprayed an environmental coating formed of a MCrAlX-type coating material. The surface of the environmental coating is then worked to cause the coating to have a surface finish of less than 2.0 micrometers Ra. Cooling holes are then drilled in the nozzle segment, after which an oxidation-resistant coating is applied on the smoothed surface of the nozzle segment so as to maintain an outermost surface on the nozzle segment having surface finish of less than 2.0 micrometers Ra.

19 Claims, 1 Drawing Sheet

GAS TURBINE NOZZLE SEGMENT AND PROCESS THEREFOR

BACKGROUND OF THE INVENTION

The present invention generally relates to components for the turbine sections of gas turbine engines. More particularly, this invention relates to a gas turbine engine nozzle segment and a process for producing such a nozzle segment to exhibit improved durability and aerodynamic performance.

Components located in the high temperature sections of gas turbine engines are typically formed of superalloys. Though significant advances in high temperature capabilities have been achieved, superalloy components must often be air-cooled and/or protected with a coating to exhibit a suitable service life in certain sections of gas turbine engines. For example, components of the turbine, combustor, and augmentor sections that are susceptible to damage by oxidation and hot corrosion attack are typically protected by an environmental coating and optionally a thermal barrier coating (TBC), in which case the environmental coating is termed a bond coat that in combination with the TBC forms what may be termed a TBC system.

FIG. 1 represents a nozzle segment 10 that is one of a number of nozzle segments that when connected together form an annular-shaped nozzle assembly of a gas turbine engine. The segment 10 is made up of multiple vanes 12, each defining an airfoil and extending between outer and inner platforms (bands) 14 and 16. The vanes 12 and platforms 14 and 16 can be formed separately and then assembled, such as by brazing the ends of each vane 12 within openings defined in the platforms 14 and 16. Alternatively, the entire segment 10 can be formed as an integral casting. When the nozzle segment 10 is assembled with other nozzle segments to form a nozzle assembly, the respective inner and outer platforms of the segments form continuous inner and outer bands between which the vanes 12 are circumferentially spaced and radially extend. Construction of a nozzle assembly with individual nozzle segments is often expedient due to the complexities of the cooling schemes typically employed. The nozzle segment 10 depicted in FIG. 1 is termed a doublet because two vanes 12 are associated with each segment 10. Nozzle segments can be equipped with more than two vanes, e.g., three (termed a triplet), or with a single vane to form what is termed a singlet.

As a result of being located in the high pressure turbine section of the engine, the vanes 12 and the surfaces of the platforms 14 and 16 facing the vanes 12 are subjected to the hot combustion gases from the engine's combustor. As previously noted, in addition to forced air cooling techniques, the surfaces of the vanes 12 and platforms 14 and 16 are typically protected from oxidation and hot corrosion with an environmental coating, which may then serve as a bond coat to a TBC deposited on the surfaces of the vanes 12 and platforms 14 and 16 to reduce heat transfer to the segment 10. Environmental coatings and TBC bond coats are often formed of an oxidation-resistant aluminum-containing alloy or intermetallic whose aluminum content provides for the slow growth of a strong adherent continuous aluminum oxide layer (alumina scale) at elevated temperatures. This thermally grown oxide (TGO) provides protection from oxidation and hot corrosion, and in the case of a bond coat promotes a chemical bond with the TBC. Environmental coatings and TBC bond coats in wide use include alloys such as MCrAlX overlay coatings (where M is iron, cobalt and/or nickel, and X is yttrium or a rare earth element), and diffusion coatings that contain aluminum intermetallics, predominantly beta-phase nickel aluminide and platinum-modified nickel aluminides (PtAl). MCrAlX-type overlay coatings may be overcoated with an aluminide diffusion coating to further promote oxidation resistance as taught in commonly-assigned U.S. Pat. No. 5,236,745.

Because TBC life depends not only on the environmental resistance but also the strength of its bond coat, bond coats capable of exhibiting higher strength have been developed, a notable example of which is a material commercially known as BC52 and disclosed in commonly-assigned U.S. Pat. No. 5,316,866. BC52 is an MCrAlX-type overlay coating material with a nominal composition of, by weight, about 18% chromium, 10% cobalt, 6.5% aluminum, 2% rhenium, 6% tantalum, 0.5% hafnium, 0.3% yttrium, 1% silicon, 0.015% zirconium, 0.06% carbon and 0.015% boron, the balance nickel. Overlay environmental coatings and bond coats are typically applied by physical vapor deposition (PVD), particularly electron beam physical vapor deposition (EBPVD), and thermal spraying, particularly plasma spraying (air, low pressure (vacuum), or inert gas) and high velocity oxy-fuel spraying (HVOF). To promote the adhesion of a TBC, bond coat materials such as BC52 are deposited to have a very rough surface finish, e.g., about 400 microinches (about 10 micrometers) Ra or more as sprayed. For this reason, BC52 bond coats for plasma sprayed TBC's have been deposited by thermal spraying a coarse BC52 alloy powder to obtain the desired as-deposited bond coat surface roughness, and do not undergo further processing to smooth their surfaces. As a result of the thermal spray deposition process, the molten powder particles deposit as "splats," resulting in the bond coat having irregular flattened grains and a degree of inhomogeneity and porosity.

The air-cooled nozzle segments of the high pressure turbine (HPT) stage 2 nozzle assembly currently used in the General Electric LM2500 industrial and marine turboshaft gas turbine engine are cast from the nickel-base superalloy known as René 80 (R80). A TBC is not required for the HPT stage 2 nozzle assembly, but the surfaces of the nozzle segments are protected with a cobalt-based MCrAlX-type overlay coating commercially known as BC22. The BC22 environmental coating is deposited and processed to have a very smooth surface finish, e.g., about 60 microinches (about 1.5 micrometers) Ra or less, in order to promote the aerodynamics of the nozzle assembly. Two processing routes have been employed, depending on whether the nozzle segments are doublets (as represented in FIG. 1) or singlets. If a singlet, the cast R80 nozzle segment undergoes drilling to form cooling holes, after which the holes are masked and the BC22 coating is applied by air plasma spraying (APS). To achieve a surface finish of 60 microinches or better, the coated casting undergoes shot peening and tumbling, after which singlet castings are brazed together to form doublets, which undergo aluminiding before being installed in the engine. If a doublet, the difficulty of depositing a uniform coating by plasma spraying necessitates that the cast R80 nozzle segment first undergo plating to deposit the BC22 coating. Thereafter, the coated casting undergoes shot peening and tumbling, after which the cooling holes are drilled and the casting undergoes aluminiding.

While the BC22 environmental coating material has performed well in the LM2500 application, improved coating durability, including oxidation and corrosion resistance, would be desirable, particularly for higher operating temperatures.

BRIEF SUMMARY OF THE INVENTION

The present invention provides a gas turbine engine nozzle segment and a process for producing such a nozzle segment to exhibit improved durability and aerodynamic performance when installed in a gas turbine engine, particularly the LM2500 industrial and marine turboshaft gas turbine engine.

The process of this invention involves producing a nozzle segment comprising at least one vane between and interconnecting a pair of platforms. The nozzle segment is cast from a gamma prime-strengthened nickel-base superalloy commercially known under the name René 125 (R125), on whose surface is deposited an environmental coating formed of the MCrAlX-type bond coat material commercially known as BC52. The surface of the environmental coating is then worked to cause the coating to have a surface finish of less than 2.0 micrometers Ra. Cooling holes are then drilled in the nozzle assembly, after which an oxidation-resistant coating is applied on the smoothed surface of the nozzle assembly so as to maintain an outermost surface on the nozzle assembly having surface finish of less than 2.0 micrometers Ra. The nozzle segment can then be installed in the gas turbine engine without a ceramic thermal barrier coating on its outermost surface defined by the environmental coating and the oxidation-resistant coating thereon.

The nozzle segment of this invention is cast from the R125 superalloy to have at least one vane between and interconnecting a pair of platforms, and is processed to have an environmental coating formed of the BC52 bond coat material on a surface of the nozzle segment and an oxidation-resistant coating on the environmental coating so as to define an outermost surface of the nozzle assembly having surface finish of less than 2.0 micrometers Ra. Cooling holes are present at the outermost surface of the nozzle assembly, which lacks a ceramic thermal barrier coating.

From the above it can be seen that the BC52 material, previously used as a roughened bond coat for a TBC, is utilized in the present invention as an environmental coating whose outer surface is free of TBC and has a smooth surface finish to promote the aerodynamic properties of the nozzle segment on which the coating is deposited. For this reason, instead of the prior practice of being deposited from a coarse powder to produce a bond coat with an as-sprayed surface roughness of 400 microinches (about 10 micrometers) Ra or more, the BC52 alloy is deposited in this invention by thermal spraying a fine powder to obtain a smooth as-sprayed surface that is capable of being further smoothed with additional processing to obtain a surface finish of less than 2.0 micrometers Ra. The present invention also avoids the prior art practice of drilling and masking cooling holes before deposition of the environmental coating, and instead provides for drilling the holes after environmental coating deposition and thereby eliminates a masking step. Finally, as an environmental coating, the BC52 material has been shown to have superior oxidation and corrosion resistance to the BC22 material currently employed as the environmental coating for nozzle segments of the LM2500 industrial and marine turboshaft gas turbine engine.

Other objects and advantages of this invention will be better appreciated from the following detailed description.

DETAILED DESCRIPTION OF THE INVENTION

Figure 1:
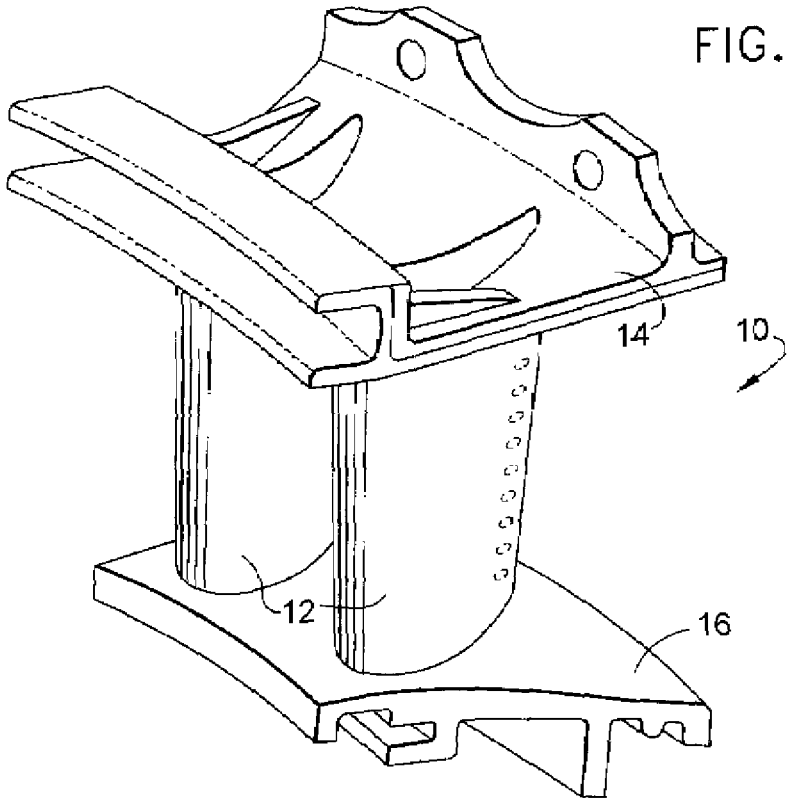
FIG. 1 represents a section of a nozzle segment of a gas turbine engine.

The present invention is generally applicable to components that operate within environments characterized by relatively high temperatures, and particularly to nozzle segments of the type represented in FIG. 1 and therefore subjected to severe oxidizing and corrosive operating environments. It should be noted that the drawings are drawn for purposes of clarity when viewed in combination with the following description, and therefore are not intended to be to scale.

Figure 2:
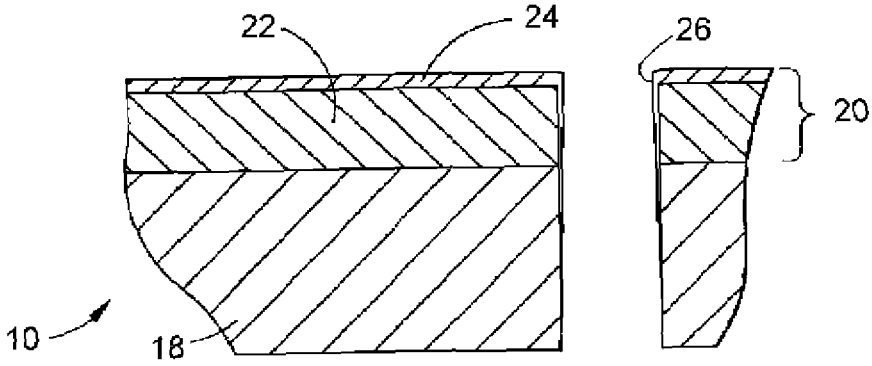
FIG. 2 is a cross-sectional view of an environmental coating system in accordance with a preferred embodiment of this invention.

An environmental coating system 20 in accordance with this invention is represented in FIG. 2 as comprising an environmental coating 22 overlying a wall region 18 of the nozzle segment 10 of FIG. 1, and a oxidation-resistant coating 24 overlying the environmental coating 22. According to a preferred aspect of the invention, the nozzle segment 10 is a casting of the gamma prime-strengthened nickel-base R125 superalloy, whose nominal composition is, by weight, about 10 percent cobalt, about 8.9 percent chromium, about 2 percent molybdenum, about 7 percent tungsten, about 3.8 percent tantalum, about 4.8 percent aluminum, about 1.55 percent hafnium, about 0.11 percent carbon, about 2.5 percent titanium, about 0.1 percent niobium, about 0.05 percent zirconium, about 0.015 percent boron, balance nickel and optional minor alloying elements. Suitable ranges for the R125 superalloy are, by weight, about 9.50-10.50 cobalt, about 8.70-9.10 chromium, about 1.60-2.40 molybdenum, about 6.60-7.40 tungsten, about 3.60-4.00 tantalum, about 4.60-5.00 aluminum, about 2.30-2.70 titanium, about 1.40-1.70 hafnium, about 0.09-0.13 carbon, about 0.10 max. niobium, about 0.03-0.07 zirconium, about 0.010-0.020 boron, the balance essentially nickel. The casting is preferably equiaxed (EA) in accordance with conventional practice in the art.

While the nozzle segment 10 is represented in FIG. 1 as being a doublet (having two vanes 12), in one embodiment of the invention the nozzle segment 10 is a singlet casting (having a single vane 12), as will be discussed in more detail below. As known in the art, the design choice between singlet and doublet castings takes into consideration the advantages associated with their different constructions and processing. A significant advantage of singlet nozzle construction is the capability for excellent coating thickness distribution around the vanes 12, which in addition to promoting oxidation and corrosion resistance also promotes control of the throat area between nozzles and uniformity between vanes of different stages. On the other hand, a doublet casting avoids the necessity for a high temperature braze operation, though with less control of coating thickness.

According to the invention, the environmental coating 22 is formed of the BC52 alloy, whose nominal composition is, by weight, about 18% chromium, 10% cobalt, 6.5% aluminum, 2% rhenium, 6% tantalum, 0.5% hafnium, 0.3% yttrium, 1% silicon, 0.015% zirconium, 0.06% carbon and 0.015% boron, the balance nickel. Suitable ranges for the BC52 alloy are reported in U.S. Pat. No. 5,316,866, whose disclosure regarding the composition, processing, and properties of BC52 are incorporated herein by reference. The BC52 alloy is believed to perform better as a bond coat at higher operating temperatures than BC22 because of better high temperature oxidation and hot corrosion resistance.

The BC52 environmental coating 22 can be deposited by a variety of thermal spray processes, preferred processes being those that avoid or minimize oxidation of the BC52 alloy during deposition. For this reason, the preferred deposition technique is a shrouded inert gas plasma spray deposition technique, though shrouded inert gas HVOF is also believed to be a suitable. In the preferred shrouded inert gas plasma spray process, the BC52 alloy is fed to a suitable plasma spray gun in powder form, with a preferred particle size being less than 38 micrometers to achieve a suitable as-deposited surface roughness of less than 200 microinches (about 5 micrometers) Ra. More particularly, using stand sieve sizes of 270, 325 , and 400, a maximum of 1 percent of the particles are between 45 and 53 micrometers, a maximum of 7 percent of the particles are between 38 and 45 micrometers, and a minimum of 93 percent of the particles are smaller than 38 micrometers. A suitable thickness for the coating 22 is about 0.002 to about 0.020 inch (about 50 to about 500 micrometers), with a thickness of about 0.005 to about 0.018 inch (about 125 to about 450 micrometers) being preferred. The environmental coating 22 can be deposited on all exterior surfaces of the nozzle 10, or can be limited to those surface regions that are more prone to oxidation damage such as, with reference to FIG. 1, the vanes 12 and the surfaces of the platforms 14 and 16 facing the vanes 12.

As noted above, the environmental coating 22 preferably has an as-deposited surface roughness of less than 200 microinches (about 5 micrometers) Ra. Thereafter, the surface of the environmental coating 22 preferably undergoes processing, preferably peening and then tumbling, to improve the surface finish of the environmental coating 22. Following peening and tumbling, the environmental coating 22 preferably has a surface roughness of not higher than 100 microinches (about 2.0 micrometers) Ra, with a typical range being about 50 to about 70 microinches (about 1.3 to about 1.8 micrometers) Ra on the concave surfaces and leading edges of the vanes 12, and about 20 to about 40 microinches (about 0.5 to 1.0 micrometer) Ra on the convex surfaces of the vanes 12.

Following deposition of the environmental coating 24, cooling holes 26 (one of which is represented in FIG. 2) are selectively drilled through the walls of the nozzle segment 10. Suitable processes for drilling the holes 26 include such precision drilling techniques as laser beam machining, electrical discharge machining (EDM) and electrostream (ES) drilling, with a preferred technique being EDM. As understood in the art, the size and orientation of the cooling holes 26 will depend on the forced air cooling technique used (e.g., impingement, film cooling, etc.), and therefore the hole 26 depicted in FIG. 2 is not intended to represent any particular embodiment of the invention. Because the cooling holes 26 are drilled after deposition of the environmental coating 22, the present invention avoids the prior requirement of masking the cooling holes 26 prior to deposition of the environmental coating 22.

If cast as a doublet, the nozzle segment 10 is ready for deposition of the oxidation-resistant coating 24 following drilling of the cooling holes 26. However, if cast as a singlet the nozzle segment 10 is preferably brazed to another, essentially identical singlet nozzle segment 10 to yield a doublet nozzle segment assembly that is similar to the doublet segment shown in FIG. 1. At locations where brazing is to occur, the coating 22 is preferably removed so as not to interfere with the brazing operation or alloy.

Finally, the oxidation-resistant coating 24 is applied to the environmental coating 22 to further promote the oxidation resistance of the nozzle segment 10. A preferred oxidation-resistant coating 24 is a diffusion aluminide coating, with a suitable thickness of about 0.0005 to about 0.004 inch (about 2 to about 100 micrometers) and a preferred thickness of about 0.002 inch (about 50 micrometers). Such overcoat-aluminide coatings are taught in commonly-assigned U.S. Pat. No. 5,236,745 to Gupta et al., whose disclosure regarding diffusion compositions and processes is incorporated herein by reference. While Gupta et al. report aluminiding by pack cementation, other processes including vapor phase aluminiding are also within the scope of the present invention. Also within the scope of the invention is the use of a platinum group metal (PGM) coating, and particularly platinum-palladium alloys deposited by electroplating, though sputtering, brush plating, etc., could alternatively be used. A suitable thickness for a plated Pt—Pd alloy coating 24 is about 0.00005 to about 0.0.0005, inch (about 1.3 to about 13 micrometers) with a preferred thickness being about 0.00015 to about 0.00035 inch (about 4 to about 9 micrometers). A preferred aspect of the oxidation-resistant coating 24 is that it does not increase the surface roughness of the environmental coating 22 beyond the range noted above, but instead maintains a surface roughness that promotes the aerodynamic and thermal properties of the coating system 20 and, therefore, the nozzle segment 10. The oxidation-resistant coating 24 can be deposited everywhere the environmental coating 22 was deposited, or can be limited to certain surface regions that are more prone to oxidation damage.

Nozzle segments produced in accordance with the above process and assembled to produce an annular nozzle are particularly well suited for use in the LM2500 industrial and marine turboshaft gas turbine engine. The combination of R125 as the superalloy for the casting and BC52 as the environmental coating 22 is believed to yield a nozzle segment 10 having significantly better oxidation and corrosion resistance than the prior combination of R80 and BC22 currently used for nozzle segments for the LM2500 engine.

While the invention has been described in terms of particular embodiment, it is apparent that other forms could be adopted by one skilled in the art. Therefore, the scope of the invention is to be limited only by the following claims.

What is claimed is:

1. A process of producing a nozzle segment of a gas turbine engine, the nozzle segment comprising at least one vane between and interconnecting a pair of platforms, the process comprising the steps of:

casting the nozzle segment from a gamma prime-strengthened nickel-base superalloy having a nominal composition of, by weight, about 10 percent cobalt, about 8.9 percent chromium, about 2 percent molybdenum, about 7 percent tungsten, about 3.8 percent tantalum, about 4.8 percent aluminum, about 1.55 percent hafnium, about 0.11 percent carbon, about 2.5 percent titanium, about 0.1 percent niobium, about 0.05 percent zirconium, about 0.015 percent boron, balance nickel and optional minor alloying elements;

depositing an environmental coating on a surface of the nozzle segment by thermal spraying a powder having a predominant particle size of less than 38 micrometers and having a nominal composition of, by weight, about 18 percent chromium, about 10 percent cobalt, about 6.5 percent aluminum, about 6 percent tantalum, about 2 percent rhenium, about 1 percent silicon, about 0.5 percent hafnium, about 0.3 percent yttrium, about 0.06 percent carbon, about 0.015 percent zirconium, about 0.015 percent boron, the balance nickel and incidental impurities;

working the surface of the environmental coating to have a surface finish of less than 2.0 micrometers Ra;

drilling cooling holes in the nozzle segment; and then applying an oxidation-resistant coating on the smoothed surface of the nozzle segment so as to maintain an outermost surface on the nozzle segment having surface finish of less than 2.0 micrometers Ra;

wherein a ceramic thermal barrier coating is not deposited on the outermost surface defined by the environmental coating and the oxidation-resistant coating thereon.

2. The process according to claim 1, wherein the nozzle segment is a singlet nozzle segment and the at least one vane is a single vane between and interconnecting the pair of platforms.

3. The process according to claim 2, wherein after the working step and before the applying step, the singlet nozzle segment is brazed with another singlet nozzle segment of substantially identical construction to form a doublet nozzle segment having two vanes between and interconnecting the pair of platforms.

4. The process according to claim 1, wherein the environmental coating is deposited by plasma spraying the powder in an inert gas shroud.

5. The process according to claim 1, wherein the environmental coating has an as-deposited surface roughness of less than 200 micrometers.

6. The process according to claim 1, wherein the oxidation-resistant coating is a diffusion aluminide coating.

7. The process according to claim 1, wherein the oxidation-resistant coating is a platinum-palladium coating.

8. The process according to claim 1, wherein the working step comprises shot peening the environmental coating and tumbling the nozzle segment.

9. The process according to claim 1, wherein the nozzle segment is cast as a doublet nozzle segment and the at least one vane is a pair of vanes between and interconnecting the pair of platforms.

10. The process according to claim 1, further comprising the step of assembling the nozzle segment with a plurality of other nozzle assemblies of substantially identical construction to form a nozzle within the gas turbine engine.

11. The process according to claim 10, wherein the gas turbine engine is an industrial and marine turboshaft gas turbine engine.

12. A nozzle segment of a gas turbine engine, the nozzle segment comprising:

at least one vane between and interconnecting a pair of platforms, the at least one vane and the pair of platforms being cast from a gamma prime-strengthened nickel-base superalloy having a nominal composition of, by weight, about 10 percent cobalt, about 8.9 percent chromium, about 2 percent molybdenum, about 7 percent tungsten, about 3.8 percent tantalum, about 4.8 percent aluminum, about 1.55 percent hafnium, about 0.11 percent carbon, about 2.5 percent titanium, about 0.1 percent niobium, about 0.05 percent zirconium, about 0.015 percent boron, balance nickel and optional minor alloying elements;

a thermal-sprayed environmental coating on a surface of the nozzle segment, the environmental coating having a nominal composition of, by weight, about 18 percent chromium, about 10 percent cobalt, about 6.5 percent aluminum, about 6 percent tantalum, about 2 percent rhenium, about 1 percent silicon, about 0.5 percent hafnium, about 0.3 percent yttrium, about 0.06 percent carbon, about 0.015 percent zirconium, about 0.015 percent boron, the balance nickel and incidental impurities;

an oxidation-resistant coating on the environmental coating and defining an outermost surface of the nozzle segment having surface finish of less than 2.0 micrometers Ra; and cooling holes in the outermost surface of the nozzle segment;

wherein a ceramic thermal barrier coating is not on the outermost surface defined by the environmental coating and the oxidation-resistant coating thereon.

13. The nozzle segment according to claim 12, wherein the nozzle segment is a singlet nozzle segment and the at least one vane is a single vane between and interconnecting the pair of platforms.

14. The nozzle segment according to claim 13, wherein the singlet nozzle segment is brazed to another singlet nozzle segment of substantially identical construction to define a doublet nozzle segment having two vanes between and interconnecting the pair of platforms.

15. The nozzle segment according to claim 12, wherein the oxidation-resistant coating is a diffusion aluminide coating.

16. The nozzle segment according to claim 12, wherein the oxidation-resistant coating is a platinum-palladium coating.

17. The nozzle segment according to claim 12, wherein the nozzle segment is cast as a doublet nozzle segment and the at least one vane is a pair of vanes between and interconnecting the pair of platforms.

18. The nozzle segment according to claim 12, wherein the nozzle segment is assembled with a plurality of other nozzle assemblies of substantially identical construction to define a nozzle within the gas turbine engine.

19. The nozzle segment according to claim 18, wherein the gas turbine engine is an industrial and marine turboshaft gas turbine engine.

* * * * *